US007789635B2

(12) United States Patent
Domberger

(10) Patent No.: US 7,789,635 B2
(45) Date of Patent: Sep. 7, 2010

(54) HIGH-PRESSURE PUMP PISTON/CYLINDER UNIT

(75) Inventor: Gerhard Domberger, Dinkelscherben (DE)

(73) Assignee: Man B&W Diesel AG, Augsburg (DE)

( * ) Notice: Subject to any disclaimer, the term of this patent is extended or adjusted under 35 U.S.C. 154(b) by 639 days.

(21) Appl. No.: 10/593,177

(22) PCT Filed: Mar. 12, 2005

(86) PCT No.: PCT/EP2005/002660

§ 371 (c)(1),
(2), (4) Date: Dec. 4, 2006

(87) PCT Pub. No.: WO2005/093249

PCT Pub. Date: Oct. 6, 2005

(65) Prior Publication Data

US 2008/0247891 A1 Oct. 9, 2008

(30) Foreign Application Priority Data

Mar. 17, 2004 (DE) ..... 10 2004 012 950

(51) Int. Cl.
*F04B 17/05* (2006.01)
*F04B 35/01* (2006.01)

(52) U.S. Cl. ..... 417/364; 123/456; 417/572

(58) Field of Classification Search ..... 417/364, 417/572; 123/456
See application file for complete search history.

(56) References Cited

U.S. PATENT DOCUMENTS 5,102,309 A 4/1992 Spehr
6,089,470 A 7/2000 Teerman et al.
6,336,443 B1 1/2002 Hlousek
6,776,140 B2 8/2004 Maier et al.
2003/0219346 A1* 11/2003 Abe et al. ..... 417/307

FOREIGN PATENT DOCUMENTS

| | | |
|---|---|---|
| DE | 40 02 557 | 8/1991 |
| DE | 100 45 281 | 5/2002 |
| DE | 203 32 361 | 2/2005 |
| EP | 0 878 621 | 11/1998 |
| EP | 1 284 367 | 2/2003 |
| EP | 1 365 142 | 11/2003 |
| JP | 9-151832 | 6/1997 |

* cited by examiner

*Primary Examiner*—Devon C Kramer
*Assistant Examiner*—Patrick Hamo
(74) *Attorney, Agent, or Firm*—Cohen Pontani Lieberman & Pavane LLP

(57) ABSTRACT

A high-pressure pump piston/cylinder unit includes a pump cylinder having a piston which oscillates therein provided in a housing. The piston is connected to a controlled drive to vary a suction and compression stroke volume of the pump cylinder. The pressure of the fluid drawn into the pump cylinder is increased by the stroke of the piston to make it available to a further supply element through a conveying valve. A centering cone in the form of a straight truncated cone having a circular base area and top area is formed integrally on the pump piston a maximum half diameter reduction of the centering cone with respect to the diameter of the piston skirt being in a ratio of approximately 1:200, and an axial length of the centering cone being designed in relation to the axial length of the entire piston skirt in a ratio of approximately 1:6.6.

2 Claims, 1 Drawing Sheet

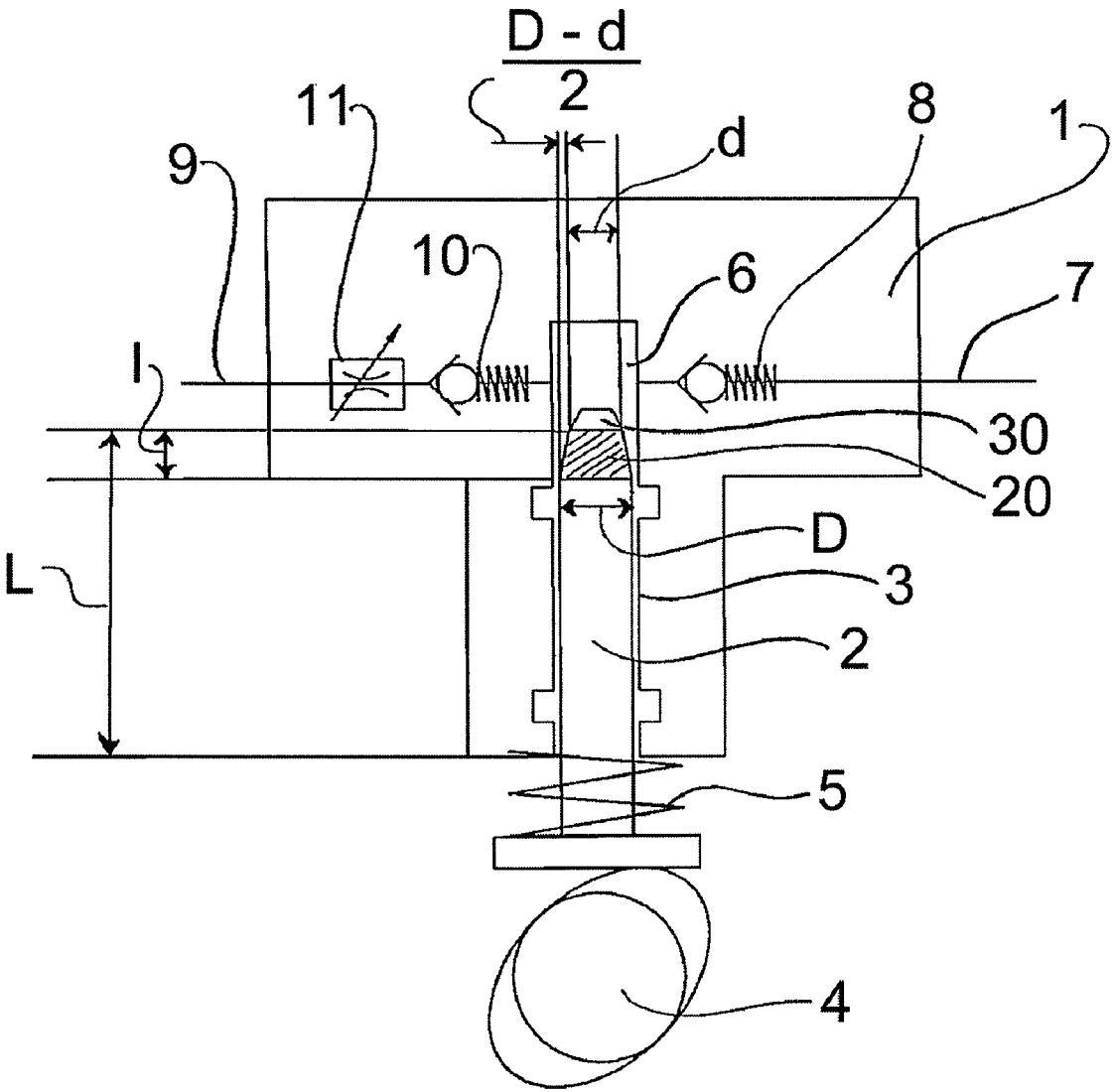
1
7
8
30
20
3
2
D
5
4
6
d
D - d
2
10
11
9
l
L

HIGH-PRESSURE PUMP PISTON/CYLINDER UNIT

PRIORITY CLAIM

This is a U.S. national stage of application No. PCT/EP2005/002660, filed on 12 Mar. 2005. Priority is claimed on the following application(s): Country: Germany, Application No.: 10 2004 012 950.9, Filed: 17 Mar. 2004, the content of which is/are incorporated here by reference.

BACKGROUND OF THE INVENTION 1. Field of the Invention

The invention relates to a high-pressure pump piston/cylinder unit of an injection pump for a common rail fuel injection system of an internal combustion engine, the piston/cylinder unit includes a housing with a pump cylinder and a piston which oscillates therein the piston having one end operatively connected on one end side to a controlled drive to vary a suction and compression stroke volume of the pump cylinder, so that the pressure of the fluid drawn into the pump cylinder from a conveying flow inlet is increased by the stroke of the piston to make the fluid available to a further supply element via a conveying valve.

The invention relates to a high-pressure pump piston/cylinder unit, in particular an injection pump for a common rail fuel injection system of an internal combustion engine, in which a pump cylinder having a piston which oscillates therein is provided in a housing, the piston being operatively connected on one end side to a controlled drive, in order to vary a suction and compression stroke volume on the other end side, the head region, in the pump cylinder, with the result that the pressure of the fluid which is sucked into the pump cylinder from a conveying flow inlet is increased by the stroke of the piston, in order to make it available to a further supply element, in particular a fuel supply means or a common rail, by means of a conveying valve. 2. Description of the Prior Art A high-pressure pump piston/cylinder unit, for example in the form of an injection pump, is part of the injection system which comprises injection lines and injection valves.

The injection pump has to fulfill a plurality of objects, such as conveying of fuel at high pressure, metering of an injection amount, injection of the fuel at the correct instant, or according to a predefined injection law. In conventional injection pumps, a camshaft which is driven by the engine lifts the injection piston, for example, by a roller tappet. The lifting speed in a four-stroke engine is equal to half the crankshaft rotational speed, and the lifting speed in a two-stroke engine is equal to the entire crankshaft rotational speed; the injection piston performs a constant stroke.

In conventional injection pumps, the metering of the injection amount takes place in a known manner by rotation of the piston about its longitudinal axis, and the conveying amount and the conveying end are determined by an oblique control edge. As soon as the latter has reached the suction hole, the fuel which is displaced by the piston flows back into the suction space.

The pump elements, that is to say injection piston and injection cylinder, are manufactured with very high accuracy and fitted into one another.

In particular, the invention relates to an injection pump for a common rail fuel injection system of an internal combustion engine. In this system, an above-described control edge is no longer required.

An injection pump of this type is described, for example, in U.S. Pat. No. 6.336,443.

The fuel which is fed to the injection pump is metered, as is known, for example, via an electromagnetically actuated metering valve. The metered fuel is then fed to the suction space or pump operating space of the piston pump, in order then to be conveyed at high pressure into a pressure storage line during operation of the internal combustion engine.

In order to avoid a pressure drop in the pressure storage line during the suction stroke, a nonreturn valve is provided at the outlet of the pump operating space. In order to avoid a return flow into the low-pressure system during the compression stroke, a nonreturn valve is likewise arranged at the conveying inlet of the pump.

High-pressure pumps of this type are also used, for example, in a fuel supply system according to U.S. Pat. No. 6,776,140.

In high-pressure pump piston/cylinder units of this type, an axial offset of the piston in the pump cylinder occurs on account of small manufacturing tolerances which can ultimately not be avoided, which has the consequence that the pressure distribution over the piston circumference is not uniform on account of gap widths which are set variously over the piston circumference. The one-sided pressing of the piston in the piston cylinder which is caused by this leads to wear in the bearing face.

In the above-described high-pressure pump piston/cylinder units, insertion bevels have also already been provided on the piston, but of unclear configuration in terms of their dimensions. Here, a conical shape having an amount of taper of a maximum of 30 μm over a length of approximately 25 mm is formed integrally on the pump piston in the head region. This reduction in the head is intended to prevent the head region of the pump piston striking the pump cylinder, but an effective countermeasure against the above-described axial offset cannot be achieved with this measure.

SUMMARY OF THE INVENTION

An object of the present invention is to provide a high-pressure pump piston/cylinder unit, in particular an injection pump for a common rail fuel injection system of an internal combustion engine, in which the risk of wear as a result of axial offset to a piston which is guided in a pump cylinder can be precluded.

The object is met by a piston/cylinder unit having a pump cylinder and pump piston, wherein a centering cone is formed integrally on the pump piston on the head region, the maximum half diameter reduction ($\frac{1}{2}\times[D-d]$) of said centering cone with respect to the diameter (D) of a piston skirt of the pump piston being in a ratio of approximately 1:200, and the axial length (1) of said centering cone, that is to say the height of the centering truncated cone, being designed in relation to the entire axial length (L) of the piston skirt (including the centering cone) in a ratio (1:L) of approximately 1:6.6. This centering cone centers the pump piston on its center axis during the compression stroke, with the result that striking on the pump cylinder is prevented. The leakage during the build-up of pressure is guided uniformly between the pump piston and the pump cylinder, with the result that the temperature distribution ("hydraulic" heat is produced during compression of the fuel) is distributed uniformly over the circumference of the pump piston. As a result, the pump piston is not heated on one side and is therefore not deformed by the action of temperature.

As a result of the uniform leakage around the circumference of the pump piston, the one-sided contact of the piston is therefore prevented in the pump cylinder, or the pressing forces are at least reduced. A further advantage which results is that the leakage flow is reduced after central orientation of the piston in the longitudinal direction of the guide face of the piston, and therefore the hydraulic efficiency of the unit is improved. It is to be seen as a further advantage that the fluid in the leakage wets the contact faces, as a result of which a lubricating effect is achieved, that is to say a lubricating gap which allows the pump piston to float is formed on the pump piston by its stroke movement.

BRIEF DESCRIPTION OF THE DRAWINGS

The single FIGURE is a schematic sectional view of an injection pump of a common rail injection system, the pump piston of which is configured according to an embodiment of the present invention.

DETAILED DESCRIPTION OF THE PREFERRED EMBODIMENTS

In the Figure, a piston 2 is guided in a pump cylinder 3 of a cylinder housing 1. The piston is moved in the conveying direction by a camshaft 4 which is driven by the engine, and is displaced back by a piston spring 5. The stroke of the piston 2 does not change, the piston 2 passes through the full stroke during each revolution of the camshaft 4 and performs a suction stroke and compression stroke.

The pump cylinder 2, that is to say the suction space or operating space 6, is connected via a high-pressure line 7 to a common rail (not shown) of the fuel injection system. A nonreturn valve 8 in the high-pressure line 7 prevents fuel from flowing back into the injection pump out of the common rail.

During the suction stroke, the piston 2 draws fuel via the fuel inlet 9 out of the low-pressure space into the pump cylinder 3 or operating space 6.

During the compression stroke, a pressure is built up in the operating space 6, which pressure leads to the opening of the nonreturn valve 8 and makes it possible to convey the fuel out of the pump cylinder 3 into the common rail (not shown).

In order to avoid a pressure drop in the operating space 6 or in the high-pressure line 7 during the compression stroke of the piston 2, a nonreturn valve 10 is likewise provided in the conveying inlet of the operating space 6, that is to say in the fuel inlet 9 out of the low-pressure space.

Furthermore, in order to meter the fuel out of the low-pressure space, an electromagnetically actuable metering valve 11 is arranged in the fuel inlet 9.

A centering cone 20 (shown with dashed lines) which is subject to sharply defined dimensioning is formed integrally on the head region of the pump piston 2.

As viewed in the direction of the camshaft 4, the centering cone 20 begins at the first completely circumferential edge of the head region of the pump piston 2 with the smallest diameter d and is enlarged continuously as far as the diameter D of the skirt of the piston 2. The centering cone 20 therefore forms a straight circular truncated cone, in which the base area (diameter D) and top area (diameter d) are of circular configuration. The conical shape of the centering cone 20 is therefore (½×[D−d]). The ratio of the conical shape (1/2×[D−d]) to the piston diameter D has to be approximately 1:200. The height l of the centering truncated cone 20 is to be dimensioned in relation to the entire piston skirt length L (piston 2 and centering cone 20) (l:L) with approximately 1:6.6.

In a particularly advantageous manner, an insertion bevel in the form of a further centering truncated cone 30 is positioned on the centering cone 20. In this case, the insertion bevel 30 and the centering cone have to be manufactured coaxially with respect to one another with a maximum tolerance of 1 μm, in order to achieve the desired effect of automatic centering of the piston 2.

The centering cone 20, advantageously assisted by the insertion cone 30, firstly brings about hydraulic pressure equalization over the circumference of the piston skirt 2 in the piston cylinder 3, and therefore prevents one-sided contact of the piston 2 on account of the fuel which enters the annular space of the leakage at high pressure in the event of an axial offset.

The centering cone can be used on all pistons which are loaded with pressure, for centering the piston.

What is claimed is:

1. A piston/cylinder unit for a high pressure pump, comprising:

a housing defining a pump cylinder;

a piston arranged in said pump cylinder and having a first end defining a head region of said piston and a second end opposing said first end;

a controlled drive acting on said second end of said piston configured to oscillate said piston in said cylinder through a suction stroke and a compression stroke;

a conveying flow inlet connected to said cylinder; and a conveying valve, wherein a fluid is drawn into said cylinder through said conveying flow inlet during the suction stroke and a pressure of the fluid in said cylinder is increased during the compression stroke for feeding the fluid through said conveying valve, and wherein said piston comprises a first centering cone at said head region comprising a truncated cone having a circular base area and a top area, wherein a ratio of a maximum half diameter reduction of said first centering cone with respect to the diameter of said piston is approximately 1:200 and a ratio of the axial length of said first centering cone to the length of said piston is approximately 1:6.6 and a bevel comprising a second centering cone positioned on said first centering cone, wherein a distance between a center axis of said first centering cone and a center axis of said second centering cone has a maximum tolerance of 1 μm.

2. The piston/cylinder unit of claim 1, wherein said piston/cylinder unit is an injection pump for a common rail fuel injection system of a motor vehicle, and wherein said controlled drive comprises a camshaft acting on said second end of said piston and a spring urging said piston out of said cylinder, said fuel comprising a fuel for an internal combustion engine.

* * * * *